US011506455B2

(12) United States Patent
Parker

(10) Patent No.: US 11,506,455 B2
(45) Date of Patent: Nov. 22, 2022

(54) PARTIAL VACUUM DRYING SYSTEM AND METHOD

(71) Applicant: Green Mountain Mechanical Design, Inc., Warren, VT (US)

(72) Inventor: James Parker, Warren, VT (US)

(73) Assignee: Green Mountain Mechanical Design, Inc., Warren, VT (US)

( * ) Notice: Subject to any disclaimer, the term of this patent is extended or adjusted under 35 U.S.C. 154(b) by 100 days.

(21) Appl. No.: 17/191,866

(22) Filed: Mar. 4, 2021

(65) Prior Publication Data

US 2021/0278133 A1 Sep. 9, 2021

Related U.S. Application Data

(60) Provisional application No. 62/985,518, filed on Mar. 5, 2020.

(51) Int. Cl.

| | |
|---|---|
| ***F26B 21/12*** | (2006.01) |
| ***F26B 9/06*** | (2006.01) |
| ***F26B 3/04*** | (2006.01) |
| ***F26B 21/10*** | (2006.01) |

(52) U.S. Cl.

CPC ..... *F26B 21/12* (2013.01); *F26B 3/04* (2013.01); *F26B 9/066* (2013.01); *F26B 21/10* (2013.01)

(58) Field of Classification Search

CPC .. F26B 21/10; F26B 21/12; F26B 3/04; F26B 9/066

USPC ..... 34/487

See application file for complete search history.

(56) References Cited

U.S. PATENT DOCUMENTS

| | | | | |
|---|---|---|---|---|
| 5,551,165 | A * | 9/1996 | Turner | H01L 21/67028 34/92 |
| 5,621,982 | A * | 4/1997 | Yamashita | H01L 21/67769 34/216 |
| 5,671,546 | A * | 9/1997 | Haala | B08B 5/04 34/92 |
| 5,937,536 | A * | 8/1999 | Kieselbach | F26B 5/044 34/92 |
| 6,226,890 | B1 * | 5/2001 | Boroson | F26B 21/083 252/194 |
| 6,256,905 | B1 * | 7/2001 | White | A23L 3/3418 34/516 |
| 6,920,701 | B2 * | 7/2005 | Haseley | F26B 5/06 34/92 |
| 9,989,309 | B1 * | 6/2018 | Griffin | F26B 17/008 |
| 10,309,722 | B1 * | 6/2019 | Troxler | F26B 5/048 |

(Continued)

*Primary Examiner* — Stephen M Gravini

(74) *Attorney, Agent, or Firm* — STGIP, LLC; Shawn Gordon

(57) ABSTRACT

A material drying system provides for consistent and efficient drying of organic materials, such as *cannabis*. In certain embodiments, a partial vacuum drying system is used to dry the materials and includes a container, a heating system, a depressurization system, and a control system. Air in the container is heated to within a range of temperatures and a low vacuum is applied to assist with evaporation. In addition, the volume flow rate of air pulled out of the container is monitored and maintained at a predetermined rate, which pulls moisture away from the materials so as to prevent degradation of the materials during the drying process while also reducing drying time. A relatively high air volume flow rate is maintained at low pressure by adjusting the area of an opening in the chamber.

15 Claims, 8 Drawing Sheets

(56) References Cited

U.S. PATENT DOCUMENTS

| | | | | |
|---|---|---|---|---|
| 11,384,980 | B2 * | 7/2022 | Triglia, Jr. | F26B 13/008 |
| 2021/0278133 | A1 * | 9/2021 | Parker | F26B 21/12 |

* cited by examiner

PARTIAL VACUUM DRYING SYSTEM AND METHOD

RELATED APPLICATION DATA

This application claims the benefit of U.S. Provisional Application No. 62/985,518, titled "Partial Vacuum Drying System and Method" and filed on Mar. 5, 2020, which is incorporated herein in its entirety.

FIELD OF THE INVENTION

The present invention generally relates to the drying of organic materials. In particular, the present invention is directed to a partial vacuum drying system and method.

BACKGROUND

*Cannabis* has been used for many hundreds of years to treat a variety of medical conditions. Historically, *cannabis* was known to have a unique ability to counteract pain which is resistant to opioid analgesics. The use of *cannabis* as prescription medicine is being revisited as a way to treat pain, seizure, and many other conditions. In addition to medical uses, *cannabis* can be used therapeutically and recreationally, and recent changes in state and national laws have introduced potential new markets for *cannabis*.

The *cannabis* plant, or *cannabis*, contains a number of chemical compounds called cannabinoids that activate cannabinoid receptors on cells that repress neurotransmitter release in the brain. The most well-known cannabinoid is the phytocannabinoid $\Delta^9$-tetrahydrocannabinol (THC), which is the primary psychoactive compound of the *cannabis* plant. However, at least 85 different cannabinoids may be extracted from the *cannabis* plant, including cannabidiol (CBD), cannabinol (CBN), tetrahydrocannabivarin (THCV), and cannabigerol (CGB).

*Cannabis* is generally cured after harvest because it cannot otherwise be effectively consumed by traditional methods. *Cannabis* generally contains about 70 to 80 percent water, but drying *cannabis* can result in better storability while retaining potency, taste profiles, and medicinal values and efficacy. However, excess drying and/or drying methods that employ too much or too high a heat will typically evaporate some of the volatile oils that give *cannabis* its unique taste and aroma.

A number of methods to dry *cannabis* exist. The most common of these methods is slow drying in which whole plants or separated colas are dried, generally in a cool dark room or other enclosed space. The *cannabis* material may be hung from a string or from pegs on a wall or laid out on drying screens. Screen drying involves spreading out *cannabis* buds on screens to dry. The screens can be laid out or placed in a dehydrator. Drawbacks to screen drying include having to remove leaves from buds and removing buds from the stems, which can be labor intensive. Moreover, it is believed that with the stem is removed, the buds can dry too quickly, making the *cannabis* harsher tasting. Screen drying can also result in uneven drying because small buds dry more quickly than larger buds.

With a drying line, colas, branches, or entire plants may be hung upside down from wire or rope lines running from wall to wall. This makes a convenient temporary hanging system, but as the bud dries, the water in the stem slowly wicks into the bud, which slows down the drying process. The slower drying process can result in a smoother taste than drying screens. Another method of slow drying is cage drying, in which buds are hung from wire cages. Because the cages can be picked up and moved, they can easily be moved closer or further from heaters, fans, and dehumidifiers as needed to ensure even drying.

Methods of speeding up the drying process include the use of fans, which decrease the chance of mold, heaters, which drive down the humidity levels, and dehumidifiers. These methods of fast drying can produce a harsher end product than slow drying. In addition, it is believed in the industry that these methods of fast drying can not only damage cannabinoids, terpenes, and flavonoids, but can also prevent the plant from reaching peak potency during the cure phase because of locked in chlorophyll.

In industrial applications, current producers of *cannabis* are generally using dehumidification alone to dry the *cannabis*, where dehumidifiers are mil at full strength until the *cannabis* materials are adequately dry, without consideration as to drying time, rate, or other potential issues that would impact the materials.

Drying of organic materials such as *cannabis* has been considered, for some time, more art than science. This is largely due to the inherent variability of organic materials. For example, even the same species of plants cut from the same field can have differing water contents, which, when dried using traditional methods, can result in materials that have different dryness. Moreover, material storage factors (e.g., time of storage, spacing/aeration techniques, storage conditions (covered, enclosed, humidity controlled, etc.)) can impact the water content of the material before the drying process begins.

Some *cannabis* has been dried using vacuum dryers with varying degrees of success. Various forms of vacuum drying have long been implemented on the premise that the boiling point of water is lowered when the surrounding atmospheric pressure is reduced, thereby reducing the energy required to dry the materials and a reduction of the possibility of excessive heat damaging the materials. However, variations of water content in the materials can result in inconsistent drying from batch to batch or even within the same batch of materials placed in the kiln.

Thus, there exists a need for a time, cost, and energy effective technique for drying materials, wherein yield is increased by reducing loss due to degradation.

SUMMARY OF THE DISCLOSURE

A system for drying a material under a partial vacuum includes a chamber having a volume, a first end, and a second end opposite the first end. A depressurization system is connected to the first end of the chamber and an opening with an area is on the second end of the chamber. A heating device is within the chamber and a control device connected to the depressurization system, the heating device, and the opening. The control device controls the area of the opening and the depressurization system such that a predetermined exchange rate of air through the container and a pressure are maintained.

In another aspect, a method for drying a material in a container under a partial vacuum while maintaining a predetermined exchange rate of air through the container includes loading the material onto a plurality of platens in the container, heating air in the container to a predetermined temperature, reducing air pressure in the container to a predetermined level, determining a volume air flow rate through the container, determining whether the volume air flow rate is at a predetermined value, and adjusting an area of an opening in the container when the volume flow rate is not at the predetermined value.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

Figure 1A:
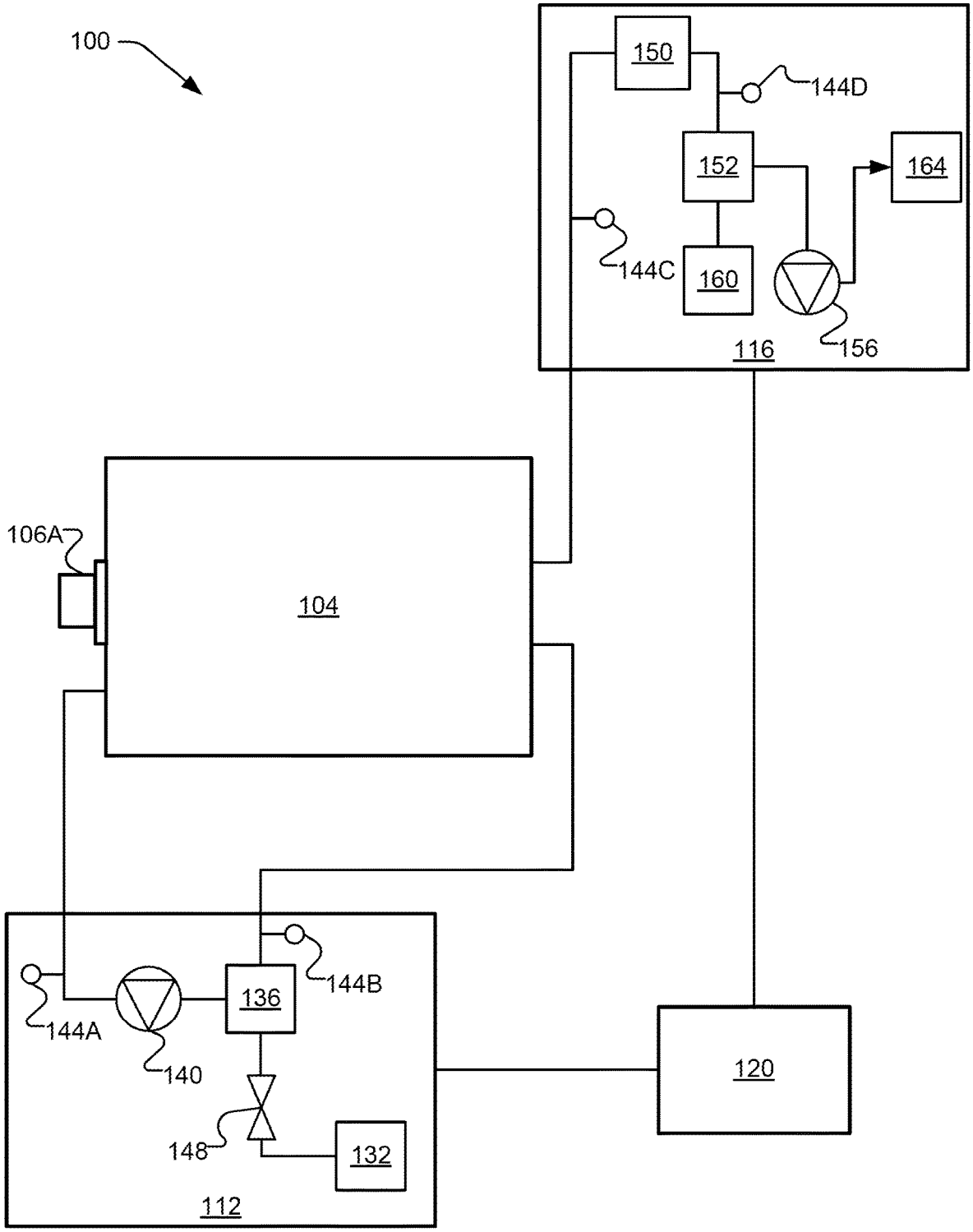
FIG. 1A is a schematic diagram of a partial vacuum dryer system according to an embodiment of the present disclosure.

A system and method according to the present disclosure provides for consistent and efficient drying of various materials including, for example, *cannabis* and related organic materials. In certain embodiments, a partial vacuum chamber is used to quickly lower the relative humidity such that *cannabis* and related organic materials are not degraded in the drying process due to high temperatures and/or high moisture levels. The suction volume flow rate is increased while maintaining a relatively low vacuum in the chamber such that a significant air exchange rate is maintained with low pressures, which is achieved through the inclusion of adjustable openings through the chamber. In this way, water vapor that is evaporated from the organic material is removed at a high rate, which lowers the relative humidity and thus helps prevent degradation of the organic material, such as enzymatic staining or mold growth. Although reference is made to the drying of organic materials throughout this disclosure, it is understood that the system and method can be used with any material in need of drying, including, but not limited to, soap, dog food, and insulation.

In addition, various measurements in the chamber can be used to reduce the chance of overheating/over-drying the materials. In certain embodiments, sensed information, such as temperature of the air, relative humidity of the air, and vacuum pressure, is used to adjust the volume air flow rate, heating system, and depressurization system via a connected control system.

A general description of the operation of a vacuum dryer, which may be used as part of the system and method of drying, will now be provided. Typically, in a vacuum dryer, layers of organic material are either stacked, hung, or otherwise distributed on hot plates or platens separating the layers of organic material until the desired stack is obtained. In a platen assembly, the platens are typically large, flat hollow structures through which hot water is circulated by means of a hot water supply and conduits to and from the platens. In some vacuum dryers, heated air is circulated around the materials, which may be separated by trays, lattices, or otherwise disposed so as to facilitate circulation. A substantially airtight container capable of handling significant vacuums houses the material during the drying process. Also, the container may preferably be constructed of an inert material such as stainless steel, due to the corrosive nature of the acids that may be removed from the material during the drying process.

Alternatively, in a preferred embodiment perforated drying trays support the layers of organic material and airflow is circulated through the trays and across the trays to assist in carrying water vapor away.

After the material has been placed inside the dryer container and the door sealed, the drying process may begin. A partial vacuum is created in the container by means of a vacuum pump connected with the interior of the dryer container and exhausting to the outside. As the vacuum increases, the moisture in the material evaporates out of the material at temperatures below the boiling point of water (if the vacuum is sufficiently high, the water will boil at room temperature). The steam or water vapor released by the material inside the container may be passed through a condenser and then pumped to the outside of the container or simply pumped directly outside. As the moisture inside the material boils and is released, the temperature of the material drops. This is due to the fact that latent energy in the moisture within the material turns to steam and leaves the material. To compensate for this loss in energy, heat can be added to the container to prevent freezing of the material or the slowing of the drying process.

In a preferred embodiment, a relatively low vacuum is maintained in the container, such as about 8 inHG Absolute. At the same time, the suction volume flow rate is maintained at a significant level even as the low vacuum pressures are reached. For example, the Standard Cubic Feet per Minute (SCFM) suction volume flow rate may be maintained at about 200 cfm while the pressure in the container is around 8 inHG Absolute. These conditions are attained by including one or more orifices in a wall of the chamber that are opposite from the wall of the chamber where the vacuum pumps are connected. This allows an air exchange rate in the range of 100 to 500 to be maintained during the drying process. Lower temperatures, such as from about 50 degrees F. to about 80 degrees F., may be maintained in the chamber under these conditions while still achieving relatively fast drying times. For example, drying may occur about five times faster under these conditions. Rapid drying in these significantly reduced temperatures prevents decarboxylation of acids in *cannabis* and enzymatic staining (browning) in many materials. The rapid drying of the air using the low vacuum and high SCFM suction volume flow rate prevents mold growth due to the fact that water vapor is removed from the air around the material at the same rate or faster than it evaporates.

Figure 1B:
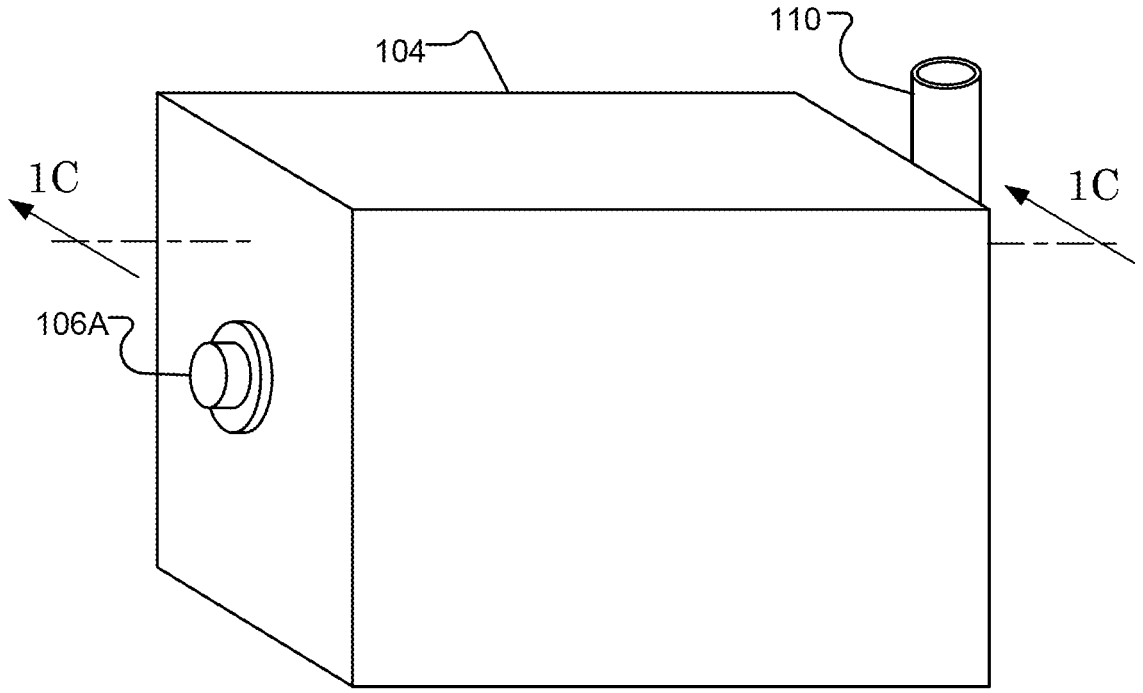
FIG. 1B is a perspective view of a chamber of a partial vacuum dryer system according to an embodiment of the present disclosure.
Figure 1C:
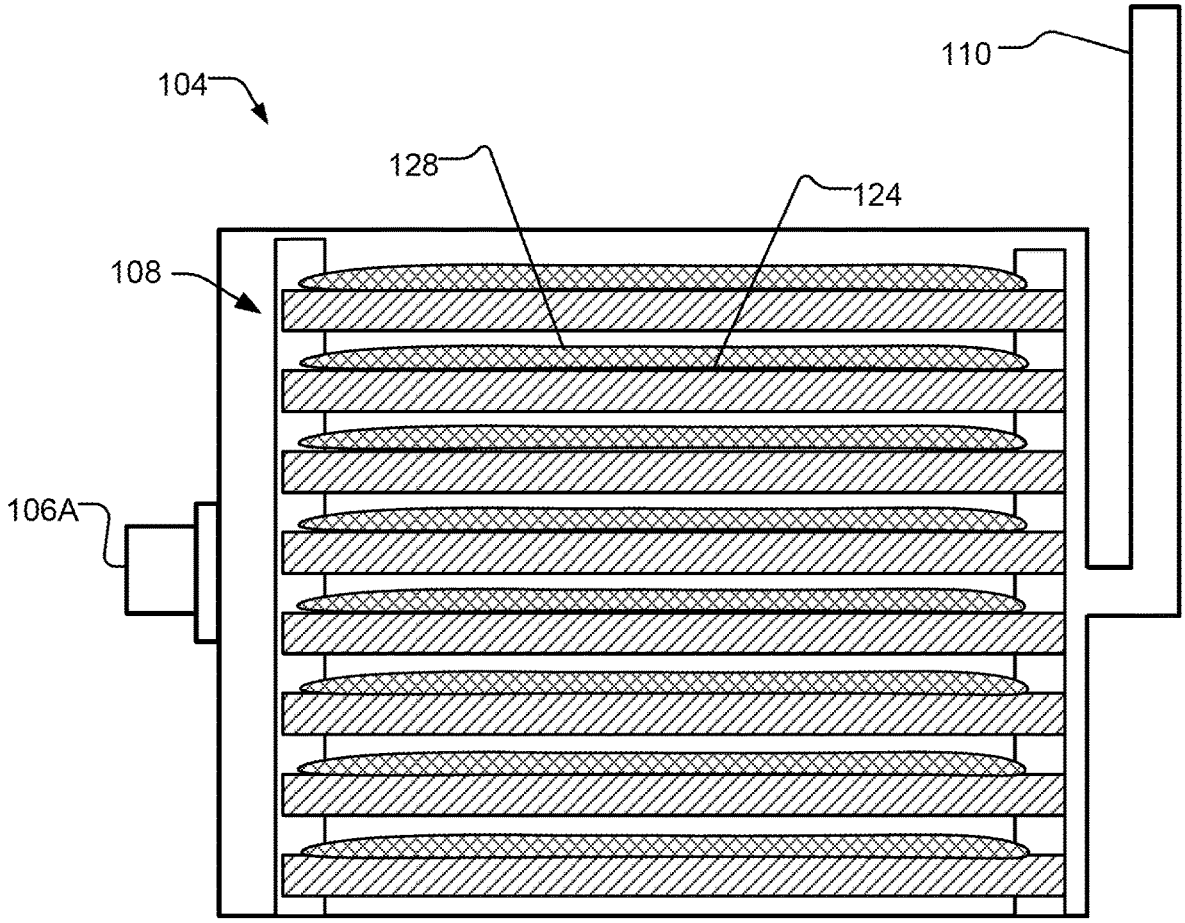
FIG. 1C is a cut-away side view of the chamber of FIG. 1B.

Referring now to FIGS. 1A-1C, there is shown an exemplary vacuum dryer system 100 that may be configured for drying *cannabis* in accordance with an embodiment of the present disclosure. Vacuum dryer system 100 includes a sealable chamber or container 104 with one or more orifices 106 (e.g., 106A), which may preferably be adjustable valve openings, the open area of which can be controlled to allow more or less ambient air into container 104. Container 104 is connected to a depressurization system 116 and can be heated in any suitable manner, including for example a removable platen assembly 108 (FIG. 1C) that is connected to a heating assembly 112. Heating system 112 may direct water through the platen assembly so as to heat up materials contained within container 104. Depressurization system 116 reduces the pressure within container 104 so as to assist with the evaporation of moisture of the materials contained within. In another embodiment, platen assembly 108 is a plurality of electrically heated plates or plates with internal electrical resistance heating elements. Heating assembly 112 and depressurization system 116 are each in communication with a control system 120, which receives information from one or more sensors (discussed below) so as to direct the operation of heating assembly 112 and depressurization system 116, as well as orifices 106.

As can be seen in FIG. 1C, platen assembly 108 may include a plurality of platens 124 that are selectively positioned in between stacked layers of a material 128 (e.g., *cannabis*). In an embodiment, platen assembly 108 includes a plurality of square or rectangular platens 124 that are fillable with a fluid, such as water, or are heated using resistance heating elements disposed within the platens. Typically, the size and configuration of each platen 124 is similar in area to the layer of material so as to provide for even heat distribution to all areas of the material. Each platen may also include on its top or bottom surface a number of separators that prevent the platen from crushing material 128. Separators may be sized and configured on platens 124 so as to provide for substantially uniform heating of materials 128 without damaging the materials. Each of platens 124 are connected on an inlet side via tubes (not shown) and/or an input manifold (not shown) and rejoined at an exit side via tubes (not shown) and/or an exit manifold (not shown) when the platens are filled with a fluid so as to facilitate fluid transfer.

In another embodiment, material is distributed on a metal belt conveyor heated by surrounding induction heaters. The use of the conveyor allows for the rotation of materials and may allow for more uniform heating of the materials (especially if the materials are non-uniform). In this embodiment, heat is transferred to materials and the conveyor by an induction heat source.

In another embodiment, material is hung inside container 104 on strings, from prebuilt pegs configured to hold the material, or laid out on drying screens or perforated platens.

Heating assembly 112 is sized and configured to provide heat to platen assembly 108 (or rollers) and consequently to material 128 so as to facilitate evaporation of fluids in the material. In an embodiment, heating assembly 112 includes a boiler 132, heat exchanger 136, a pump 140, and one or more thermocouples 144 (e.g., thermocouples 144A and 144B). In an exemplary embodiment, boiler 132 is a steam boiler that is fluidly coupled to heat exchanger 136. Heat exchanger 136 receives a heated fluid from boiler 132 and transfers the heat in the fluid to the fluid that enters and exits platen assembly 108. Heat exchanger 136 can be a shell-and-tube, plate/fin, or any other type of heat exchanger suitable to transfer heat from boiler 132 to platen assembly 108. Generally, for shell and tube heat exchangers, one fluid flows through a set of metal tubes while a second fluid passes through a sealed shell that surrounds the metal tubes. Plate/fin heat exchangers include a plurality of thin metal plates or fins, which results in a large surface area for transferring heat.

In another embodiment of heating assembly 112, the heating assembly is a hot air assembly that delivers hot air within container 104. Hot air may be directed by fans through perforated platens, screens, or around hanging materials 128.

Pump 140 is a fluid pump capable of moving a fluid, typically water, through the platen assembly 108. The temperature of the fluid going to or coming from platen assembly 108 is measured by thermocouples 144A and 144B, respectively. Thermocouples 144 can be most any type of thermocouple that is capable of measuring fluid temperatures that are typically below 200° Fahrenheit. As explained in more detail below, thermocouples 144 are coupled to control system 120, which uses the signals generated by the thermocouples, and other information, to control the heat coming from boiler 132 (typically via valve 148).

Depressurization system 116 creates a partial vacuum in container 104 so as to lower the atmospheric pressure within the container and thereby facilitate evaporation of fluids from material 128. In an embodiment, depressurization system 116 may include a condenser 150, a first separator 152, a vacuum pump 156, a condensate drain tank 160, a second separator 164, and additional thermocouples 144 (thermocouples 144C and 144D). In another embodiment, a cold trap is positioned between the vacuum pump and the chamber to capture condensed terpenes.

Condenser 150 removes liquids (typically water) from air pulled from container 104. As the primary purpose of partial vacuum dryer system 100 is to dry material 128, the liquid removed from the materials is desirably evacuated so as to lower the humidity in container 104. In an embodiment, condenser 150 is an air-cooled condenser whereby air from container 104 is drawn into a plurality of tubes or plates while a fan moves external air across the tubes or plates. This process causes the air inside the tubes or plates to cool, which precipitates liquids that can be removed by separator 152. Other types of condensers can be used, such as, but not limited to, water cooled condensers or evaporative condensers.

Separator 152 is fluidly coupled to condenser 150 and serves to remove condensate generated by condenser 150. Condensate separators come in a variety of types such as, but not limited to, chemical adsorption separators, gravitational separators, mechanical separators, and vaporization separators. In an exemplary embodiment, separator 152 is a gravitational separator that allows the condensate to flow to condensate drain tank 160. In operation, the condensate stream from condenser 150 is passed into a large space, which decreases the transfer speed thereby allowing the liquid particles in the stream to sink from the condensate stream.

Vacuum pump 156 is sized and configured to create a partial vacuum in container 104. In an exemplary embodiment, vacuum pump 156 is sized and configured to lower the atmospheric pressure in the container between about 0.5 inHG Absolute and 10 inHG Absolute. In an embodiment, vacuum pump 156 is a liquid ring pump or rotary vane pump, which compresses gas by rotating an impeller disposed within a cylindrical casing. In a preferred embodiment, vacuum pump 156 is a claw style vacuum pump or a screw pump, which provide a large volume of vacuum suction capacity as needed to remove water vapor quickly from the chamber. A fluid (usually water) is fed into the vacuum pump and, by centrifugal acceleration, forms a moving cylindrical ring against the inside of the casing, thereby creating seals in the space between the impeller vanes, which form compression chambers. Air from container 104 is drawn into vacuum pump 156 through an inlet port in the end of the casing, and then is trapped in the compression chambers formed by the impeller vanes and the liquid ring and exits through a discharge port.

Depressurization system 116 and vacuum pump 156 are sized such that the suction volume flow rate out of container 104 can be maintained at from about 100 cfm to about 400 can depending on chamber size and capacity of material to be dried. In order to maintain these flow rates while also maintaining a low vacuum in container 104, orifices 106 (e.g., 106A) are disposed in an end of container 104 that allow ambient air to enter container 104. Preferably, the point of connection of decompression system 116 to container 104, such as outlet pipe 110, is on an end that is opposite the location of orifice 106, as arranged in FIGS. 1A-1C. In one embodiment, orifice 106 may be from about ½ inch to about 2 inches or larger in diameter, which provides for open areas of between about 2 square inches and 10 square inches, and in a container with a volume of about 500 cubic feet allows depressurization system 116 to sustain a pressure of about 8 inHG Absolute in container 104 while also having a flow rate of about 200 cfm. A modulating valve at the inlet port expands and contracts the open area of orifice 106 as necessary to maintain the vacuum pressure while allowing for maximum air exchange at that pressure. In this way, an air exchange rate of 12,000 cubic feet per hour in some embodiments or about 200 cfm per volume of container may be maintained during the drying process. Ambient air entering container 104 through orifice 106 expands rapidly in the low pressure environment, which causes the relatively humidity of the incoming air to be significantly reduced, which further assists the in removal of moisture from the material.

Air leaving vacuum pump 156 is sent to second separator 164, which separates liquids from the air. Separated liquid is returned for use in vacuum pump 156. In an embodiment, second separator 164 is a gravitational separator that passes the air leaving vacuum pump 156 into a large space, which decreases the transfer speed thereby allowing the liquid particles in the air to be separated.

Control system 120 is configured to adjust the depressurization of container 104 and the temperature of the air in the container by, for example, adjusting the temperature of the fluid going through platen assembly 108, in response to the real-time evaporation conditions of the fluid in material 128. In an embodiment, control system 120 is in communication with components of heating system 112 and depressurization system 116 so as to control the rate of evaporation from material 128 and to maintain a selected air exchange rate through the container while also maintaining a selected low vacuum pressure.

Relative humidity may be controlled by controlling the size of orifices 106 that allow air to leak into the chamber under vacuum. By adding more area for leaks, the vacuum pump will pull more air through the chamber, thereby removing more moisture and lowering the relative humidity. On the other hand, by decreasing the area of orifices 106, creating a more sealed chamber, the vacuum may slow down or stop, in which case less moisture vapor will be removed and the relative humidity will increase during the drying process. Therefore, by controlling the area of the orifices, the dryer may control relative humidity to maintain a selected rate of moisture loss in the product being dried in the chamber.

Figure 2:
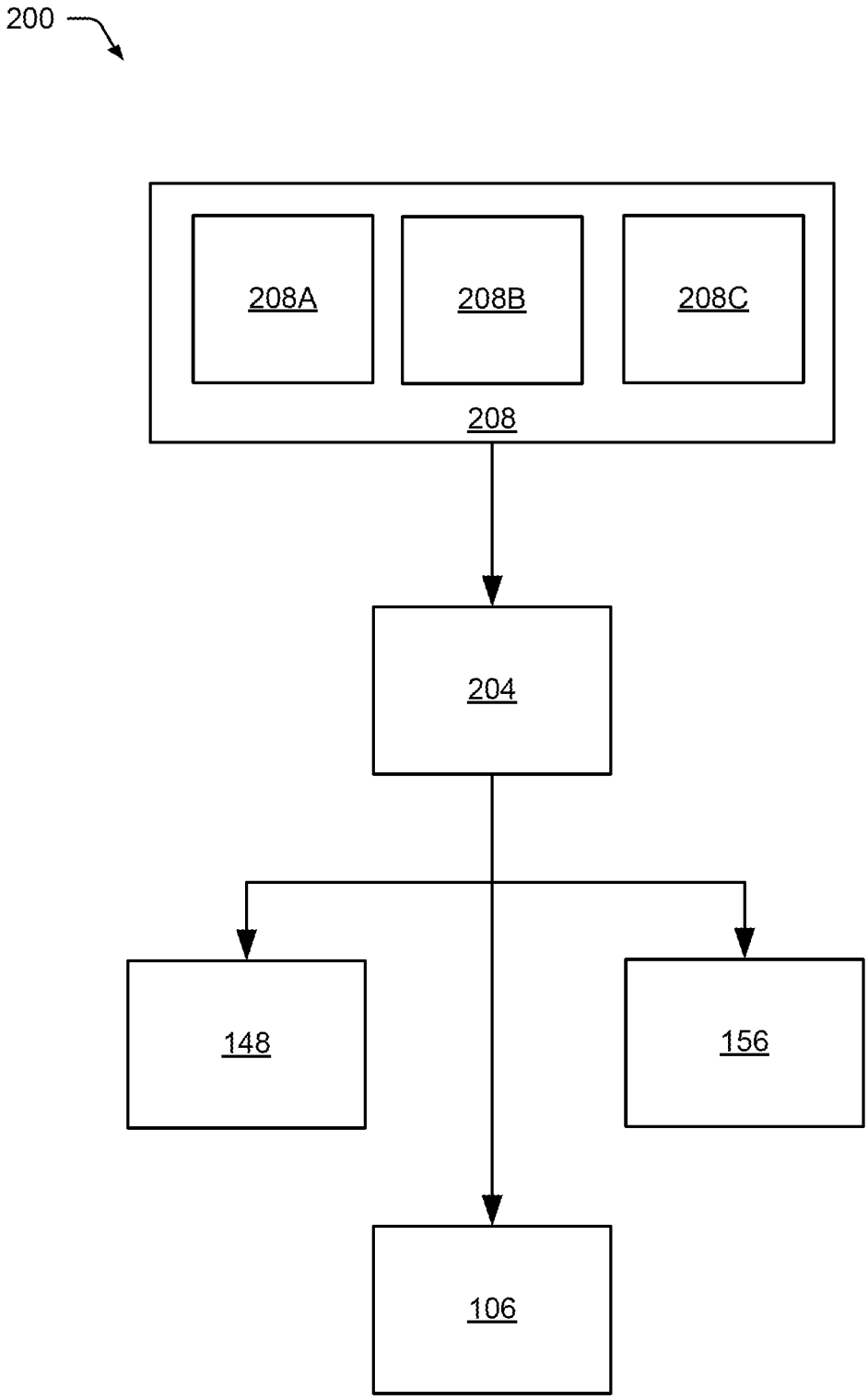
FIG. 2 is a block diagram of an exemplary control system according to an embodiment of the present disclosure.

An embodiment of a control system suitable for use with vacuum dryer system 100 is shown in FIG. 2 as control system 200. Control system 200 includes a programmable logic controller (PLC) 204, which, as shown, receives inputs from many different sensors, and sends commands to others components, based upon the inputs and the various software routines run by the PLC 204. These routines can be integrated with each other, as well as be discrete modules which operate on their own, or a combination of both.

As shown, PLC 204 is in electronic communication with a plurality of sensors 208. For example, sensors 208 can be temperature sensors 208A that provide a signal, indicative of a temperature, of:

the fluid entering platen assembly 108;
the fluid exiting platen assembly 108;
the air entering container 104;
the air in container 104 near or around material 128;
the air exiting container 104;
the air exiting condenser 150; and
the material 128.

In a preferred embodiment, at least one temperature sensor is inserted into a portion of material 128 such that moisture cannot escape around the temperature sensor. The desired result is that the measured internal temperature of the material 128 is effectively the wet-bulb temperature, which is the lowest temperature that can be reached under current ambient conditions by the evaporation of water only. In addition, a relative humidity sensor may be included in the chamber.

Having temperature sensors 208A inside material 128 (and preferably multiple ones at different locations throughout the material), and at different locations related to heat inputs and outputs (such as at the heating fluid entrance to platen assembly 108 and at the heating fluid exit of the platen assembly), and optionally, before and after condenser 150, allows for determinations regarding the state of evaporation of water from the material. It should be noted that humidity sensors can be used in addition to or in certain embodiments substituted for temperature sensors 208A.

In addition or in the alternative, sensors 208A may measure the temperature of air in container 104, and preferably the air near or around material 128. In a preferred embodiment, the air in container 104 is maintained at about 50-80 degrees F. during the drying process. If necessary, such as when ambient air is below freezing, ambient air may be pre-heated before it enters container 104 through orifice 106.

Sensors 208 can also provide information related to the duty cycle of vacuum pump 156 by indicating when the vacuum pump is being used or when it is off. For example, a duty cycle sensor 208B, which can be a frequency monitor, can send a signal representative of the power usage by vacuum pump 156 to PLC 204.

Sensors 208 can also provide information related to the vacuum in container 104. Sensors 208 suitable for measuring the vacuum can include, for example, pressure transmitters and pressure transducers. In an embodiment, at least one pressure sensor 208C is in electronic communication with PLC 204, the pressure sensor sending a signal representative of a pressure inside container 104.

Inputs from sensors 208 can then be used to regulate control valve 148 that is disposed between boiler 132 and heat exchanger 136, thereby controlling the temperature of the fluid going to platen assembly 108. Input from sensors 208 can also be used to increase/decrease the air flow through condenser 150 so as to ensure efficient operation of the equipment and vacuum pump 156.

PLC 204 can also monitor power consumption so as to determine the rate of evaporation occurring within container 104. For example, receiving information from sensor 208B can indicate how often vacuum pump 156 is being actuated to maintain the desired pressure within container 104. It should be noted that the pressure within container 104 changes in response to evaporation from material 128 (gases have larger volumes than liquids). As such, sensor 208B can provide an indication of the power usage/duty cycle of vacuum pump 156.

While PLC 204 is shown as part of control system 120, it is understood that multiple PLCs can be employed and can contain software written to both act upon input signals obtained from other sensors or other components and ensure that the various components operate together.

In a preferred embodiment, PLC 204 is configured so as to efficiently and effectively control the evaporation of moisture from material 128. Efficient and effective evaporation occurs, in an embodiment, by monitoring the temperature of material 128 (or a representative sample of the material) and adjusting the input temperature of the fluid going to platen assembly 108. In addition or in the alternative, the flow rate of air through container 104 is monitored in conjunction with the pressure in container 104, and PLC 204 controls vacuum pump 156 to maintain a relatively high flow rate (e.g., 200 cfm) while a relatively low vacuum is maintained (e.g., 8 inHG Absolute). Additionally, PLC 204 may be used to adjust the size of orifices 106 to assist in maintaining those conditions. As a result, a selected air exchange rate through the container is maintained during the drying process.

Figure 3:
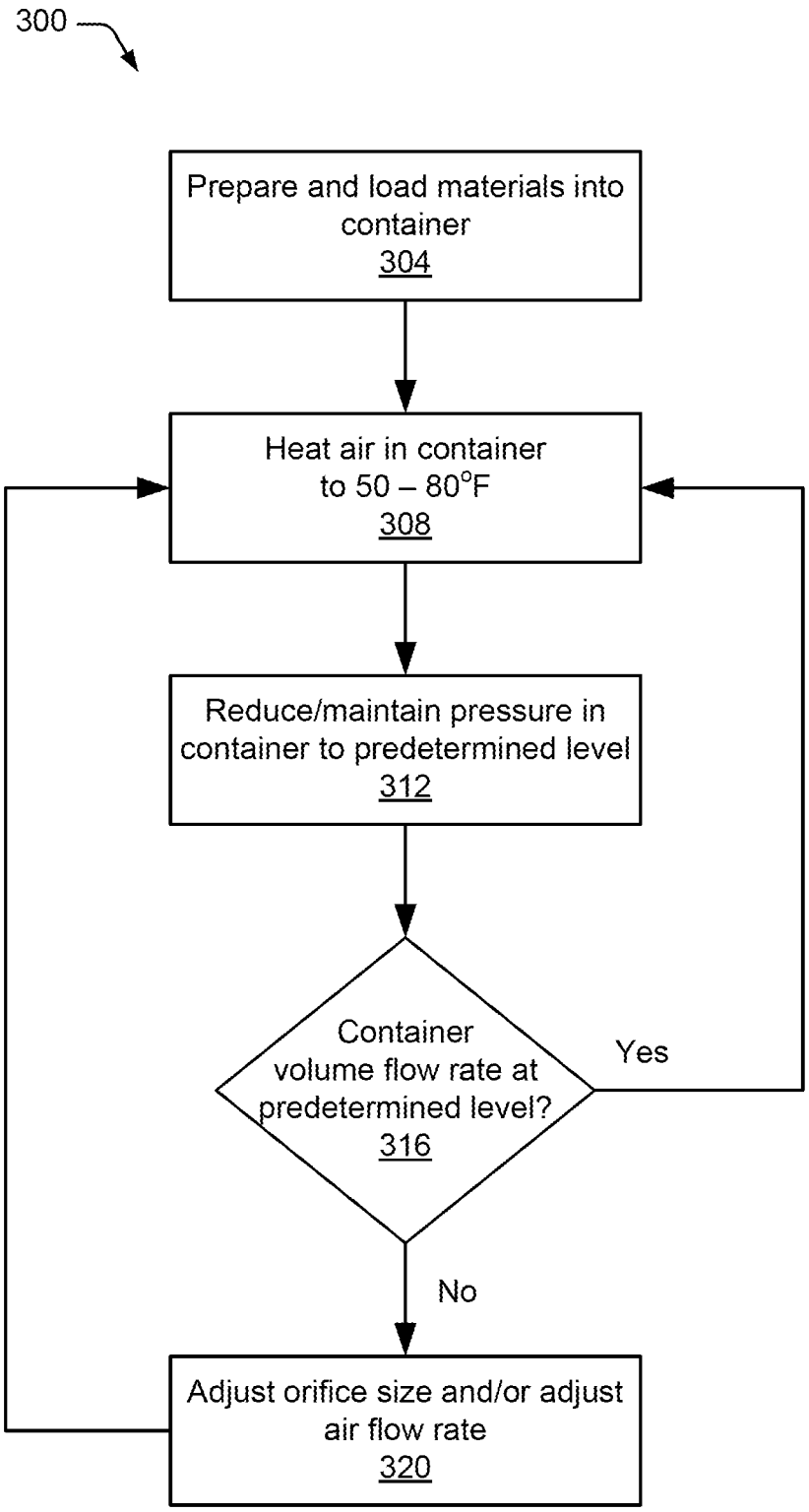
FIG. 3 is a process diagram of an exemplary process of drying materials according to an embodiment of the present invention.

In FIG. 3 there is shown a process 300 suitable for operating a partial vacuum dryer system, such as vacuum dryer system 100, so as to achieve consistent and efficient drying of an organic material. At step 304, the material is prepared and loaded into the container. To begin the drying process, the air in the container is heated, as needed, to within a predetermined temperature range, such as about 50-80 degrees F., at step 308 while the pressure is reduced in the container to a predetermined level at step 312, such as about 6-10 inHG Absolute. At step 316, the container volume flow rate is determined. If the flow rate is at at least a predetermined level, such as 200 cfm, that is correlated with the desired air exchange rate for the particular container being used, then the temperature and pressure parameters are rechecked and any adjustments are made at steps 308 and 312. If the container volume flow rate is below the predetermined level, the opening or orifice size is adjusted to allow more ambient air into the container and/or the flow rate is adjusted by controlling the depressurization system at step 320. After this adjustment(s), the process returns to steps 308-316 such that during the dying process the predetermined temperature, pressure, and flow rate ranges are maintained such that a selected air exchange rate is maintained. Once the material reaches a predetermined dryness level (determined as described above), the drying process is completed.

Figure 4A:
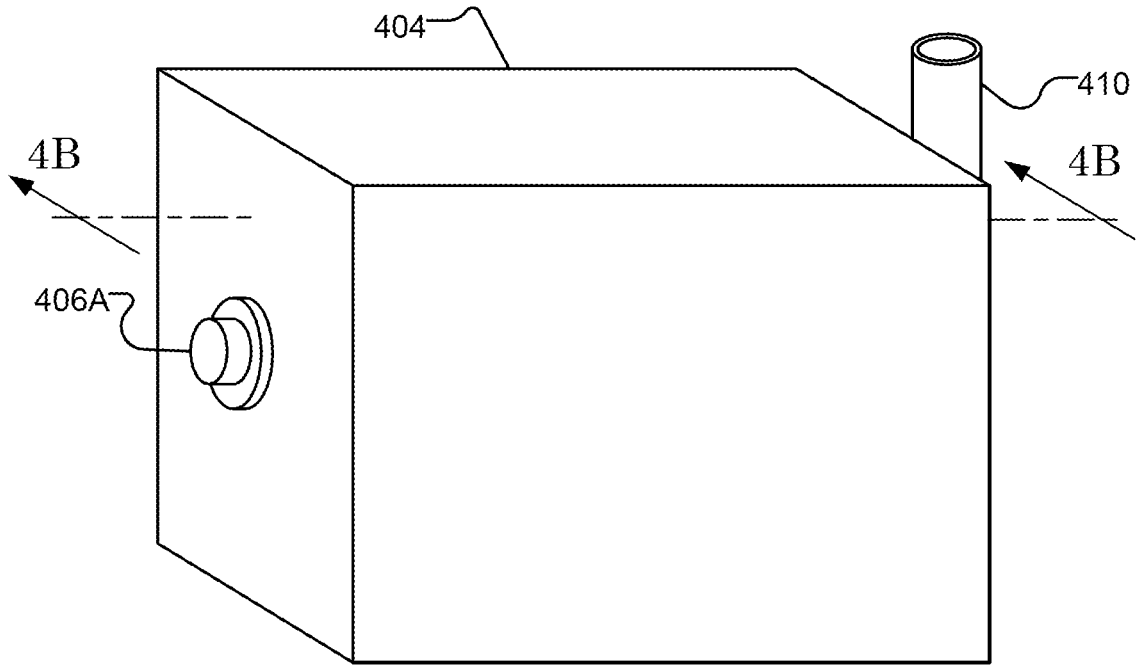
FIG. 4A is a perspective view of a chamber of a partial vacuum dryer system according to another embodiment of the present disclosure.
Figure 4B:
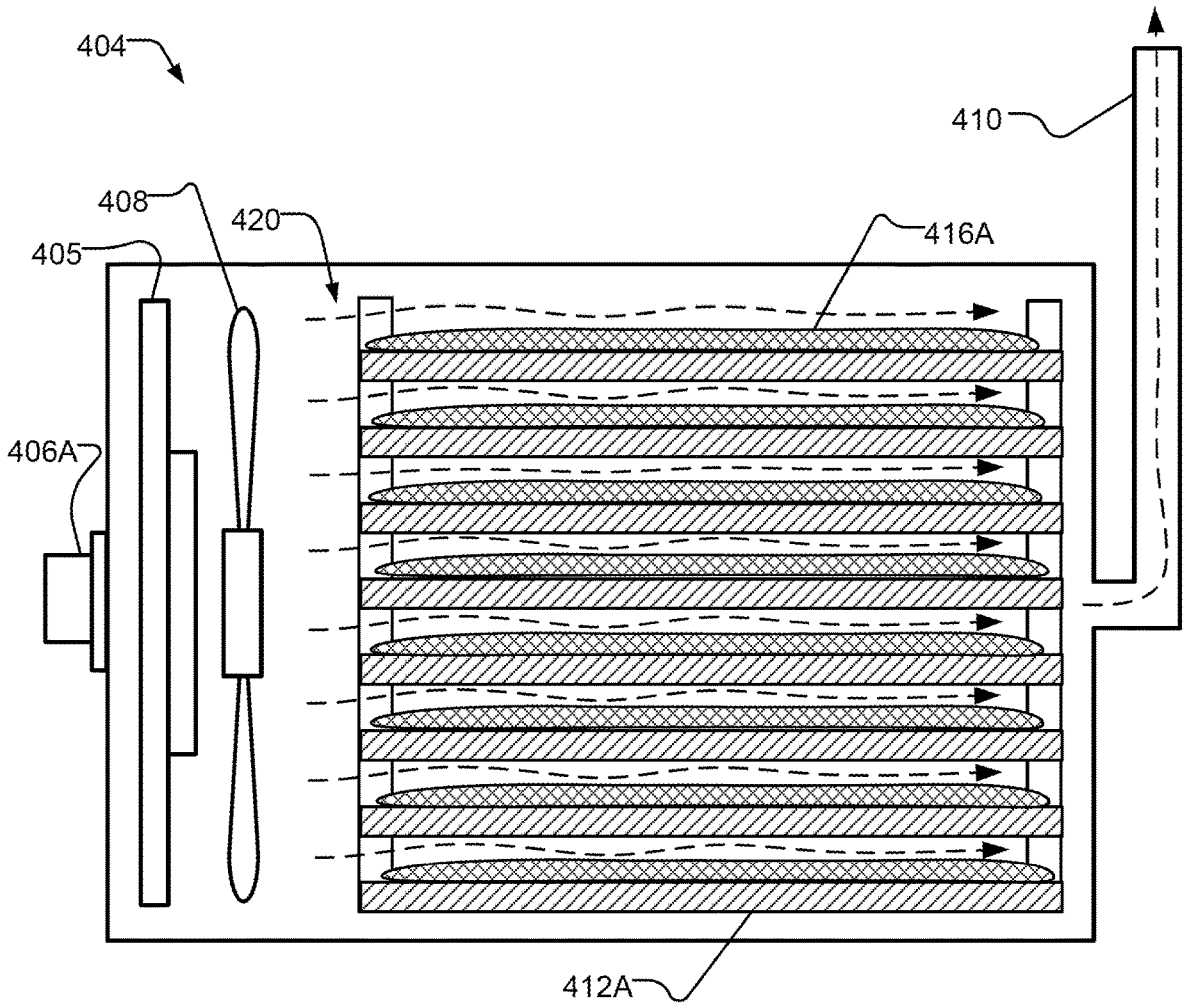
FIG. 4B is a cut-away side view of the chamber of FIG. 4A.

In FIGS. 4A-4B, a chamber 404 of another embodiment of a partial vacuum drying system is shown that includes a heating/air movement system within chamber 404. A heating element 405 is located in proximity to a fan 408 that creates an airflow (depicted as arrows 420) that flows through and across perforated drying trays 412 (e.g., 412A) that support organic material 416 (e.g., 416A). In a preferred embodiment, the heating/air movement system components are positioned between opening 406A and trays 412, with trays 412 located between the heating/air movement system components and outlet pipe 410 that is connected to the depressurization system.

Figure 5:
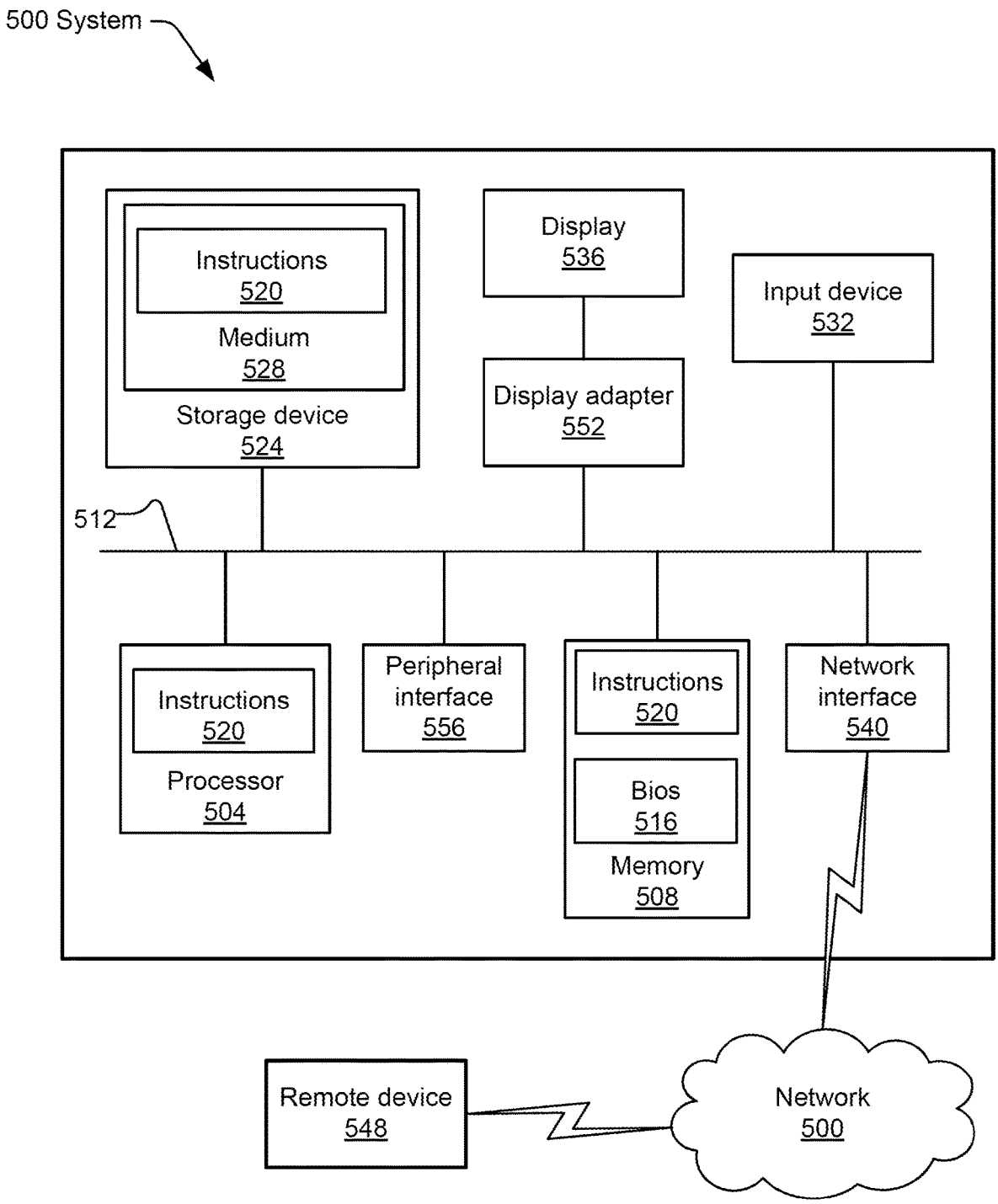
FIG. 5 is a block diagram of an exemplary computing system suitable for use with one or more of the components discussed herein.

FIG. 5 shows a diagrammatic representation of one embodiment of a computing device in the form of a system 500 within which a set of instructions for causing a device, such as control system 120 or PLC 204, to perform any one or more of the aspects and/or methodologies of the present disclosure may be executed, such as process 300. It is also contemplated that multiple computing devices may be utilized to implement a specially configured set of instructions for causing the device to perform any one or more of the aspects and/or methodologies of the present disclosure. System 500 includes a processor 504 and a memory 508 that communicate with each other, and with other components, via a bus 512. Bus 512 may include any of several types of bus structures including, but not limited to, a memory bus, a memory controller, a peripheral bus, a local bus, and any combinations thereof, using any of a variety of bus architectures.

Memory 508 may include various components (e.g., machine readable media) including, but not limited to, a random-access memory component (e.g., a static RAM "SRAM", a dynamic RAM "DRAM", etc.), a read only component, and any combinations thereof. In one example, a basic input/output system 516 (BIOS), including basic routines that help to transfer information between elements within system 500, such as during start-up, may be stored in memory 508.

Memory 508 may also include (e.g., stored on one or more machine-readable media) instructions (e.g., software) 520 embodying any one or more of the aspects and/or methodologies of the present disclosure. In another example, memory 508 may further include any number of program modules including, but not limited to, an operating system, one or more application programs, other program modules, program data, and any combinations thereof.

System 500 may also include a storage device 524. Examples of a storage device (e.g., storage device 524) include, but are not limited to, a hard disk drive for reading from and/or writing to a hard disk, a magnetic disk drive for reading from and/or writing to a removable magnetic disk, an optical disk drive for reading from and/or writing to an optical medium (e.g., a CD, a DVD, etc.), a solid-state memory device, and any combinations thereof. Storage device 524 may be connected to bus 512 by an appropriate interface (not shown). Example interfaces include, but are not limited to, SCSI, advanced technology attachment (ATA), serial ATA, universal serial bus (USB), IEEE 1494 (FIREWIRE), and any combinations thereof. In one example, storage device 524 (or one or more components thereof) may be removably interfaced with system 500 (e.g., via an external port connector (not shown)). Particularly, storage device 524 and an associated machine-readable medium 528 may provide non-volatile and/or volatile storage of machine-readable instructions, data structures, program modules, and/or other data for system 500. In one example, instructions 520 may reside, completely or partially, within machine-readable medium 528. In another example, instructions 520 may reside, completely or partially, within processor 504.

System 500 may also include an input device 532. In one example, a user of system 500 may enter commands and/or other information into system 500 via input device 532. Examples of an input device 532 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), touch screen, and any combinations thereof. Input device 532 may be interfaced to bus 512 via any of a variety of interfaces (not shown) including, but not limited to, a serial interface, a parallel interface, a game port, a USB interface, a FIREWIRE interface, a direct interface to bus 512, and any combinations thereof. Input device 532 may include a touch screen interface that may be a part of or separate from display 536, discussed further below. Input device 532 may be utilized as a user selection device for selecting one or more graphical representations in a graphical interface so as to provide inputs to control system 120. Input device 532 may also include, signal or information generating devices, such as sensors 208. The output of the input devices can be stored, for example, in storage device 524 and can be further processed by processor 504.

A user may also input commands and/or other information to system 500 via storage device 524 (e.g., a removable disk drive, a flash drive, etc.) and/or network interface device 540. A network interface device, such as network interface device 540 may be utilized for connecting system 500 to one or more of a variety of networks, such as network 544, and one or more remote devices 548 connected thereto. Examples of a network interface device include, but are not limited to, a network interface card (e.g., a mobile network interface card, a LAN card), a modem, and any combination thereof. Examples of a network include, but are not limited to, a cloud-based network, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 544, may employ a wired and/or a wireless mode of communication. In general, any network topology may be used. Information (e.g., data, instructions 520, etc.) may be communicated to and/or from system 500 via network interface device 540.

System 500 may further include a video display adapter 552 for communicating a displayable image to a display device, such as display device 536. Examples of a display device include, but are not limited to, a liquid crystal display (LCD), a cathode ray tube (CRT), a plasma display, a light emitting diode (LED) display, and any combinations thereof. Display adapter 552 and display device 536 may be utilized in combination with processor 504 to provide a graphical representation of the evaporation process. In addition to a display device, a system 500 may include one or more other peripheral output devices including, but not limited to, an audio speaker, a printer, and any combinations thereof. Such peripheral output devices may be connected to bus 512 via a peripheral interface 556. Examples of a peripheral interface include, but are not limited to, a serial port, a USB connection, a FIREWIRE connection, a parallel connection, and any combinations thereof.

Exemplary embodiments have been disclosed above and illustrated in the accompanying drawings. It will be understood by those skilled in the art that various changes, omissions, and additions may be made to that which is specifically disclosed herein without departing from the spirit and scope of the present invention.

What is claimed is:

1. A system for drying a material under a partial vacuum comprising:

a chamber having a volume, a first end, and a second end opposite the first end;

a depressurization system connected to the first end of the chamber;

an adjustable valve opening on the second end of the chamber, the opening having an area exposed to ambient air;

a heating device within the chamber; and a control device connected to the depressurization system, the heating device, and the adjustable valve opening, wherein the control device controls the area of the adjustable valve opening and the depressurization system such that a predetermined exchange rate of air through the chamber and a pressure are maintained.

2. The system of claim 1, wherein the control device controls the area of the adjustable valve opening and the depressurization system such that an air change rate through the chamber is at least 200 cubic feet per minute per the volume of the chamber and the pressure is about 6-10 inHG Absolute.

3. The system of claim 2, further including a temperature sensor, wherein a temperature of air in the chamber is maintained at between 40 degrees F. and 90 degrees F. while drying the material.

4. The system of claim 3, further including a pressure sensor in the chamber, wherein the pressure sensor is connected to the control device.

5. The system of claim 2, further including a plurality of trays, wherein each of the plurality of trays include a plurality of perforations for airflow.

6. The system of claim 5, further including an air movement device proximate the heating device, wherein the air movement device is positioned to push air across the plurality of trays.

7. The system of claim 6, wherein the heating device and the air movement device are positioned between the adjustable valve opening and the plurality of trays and wherein the plurality of trays are positioned between the air movement device and the first end of the chamber.

8. The system of claim 1, wherein the area of the adjustable valve opening is between 2 square inches and 10 square inches.

9. A method for drying a material in a container under a partial vacuum while maintaining a predetermined exchange rate of air through the container, wherein the container has a volume, the method comprising:

loading the material onto a plurality of platens in the container;

heating air in the container to a predetermined temperature;

reducing air pressure in the container to a predetermined level;

determining a volume air flow rate through the container;

determining whether the volume air flow rate is at a predetermined value when the air pressure is at the predetermined level; and adjusting an area of an opening in the container when the volume flow rate is not at the predetermined value.

10. The method of claim 9, further including adjusting a flow rate of a depressurization system connected to the container when the volume air flow rate is not at the predetermined value.

11. The method of claim 9, wherein the area of the opening is increased when the volume air flow rate is below the predetermined value.

12. The method of claim 11, wherein a flow rate of a depressurization system is increased when the air pressure is above the predetermined level.

13. The method of claim 9, wherein a flow rate of a depressurization system is increased when the volume air flow rate is below the predetermined value.

14. The method of claim 9, wherein the predetermined value of the volume air flow rate is 200 cubic feet per minute per the volume of the container.

15. The method of claim 13, wherein the predetermined level of the air pressure is about 6-10 inHG Absolute.

* * * * *